US008763292B1

(12) United States Patent
Morad et al.

(10) Patent No.: US 8,763,292 B1
(45) Date of Patent: Jul. 1, 2014

(54) WET FLOOR CAUTION SIGN

(75) Inventors: Fred I. Morad, Toluca Lake, CA (US); William P. Camp, Jr., Vanlue, OH (US)

(73) Assignee: Worldwide Integrated Resources, Inc., Commerce, CA (US)

( * ) Notice: Subject to any disclaimer, the term of this patent is extended or adjusted under 35 U.S.C. 154(b) by 262 days.

(21) Appl. No.: 13/136,055

(22) Filed: Jul. 21, 2011

(51) Int. Cl.
*G09F 15/00* (2006.01)

(52) U.S. Cl.
USPC ..... 40/610; 116/63 T; 40/606.15

(58) Field of Classification Search
USPC ..... 40/606.12, 606.14, 606.15, 606.16, 40/610, 506, 497, 493, 496; 116/63 P, 116/63 T; 160/223
See application file for complete search history.

(56) References Cited

U.S. PATENT DOCUMENTS

| | | | | |
|---|---|---|---|---|
| 3,318,279 | A * | 5/1967 | Padilla | 116/63 R |
| 5,626,926 | A * | 5/1997 | Roberts | 428/14 |
| 6,095,226 | A * | 8/2000 | Chen et al. | 160/135 |
| 7,874,090 | B2 * | 1/2011 | Flagg | 40/605 |
| 2011/0094058 | A1 * | 4/2011 | Van Gennep | 16/327 |
| 2012/0006498 | A1 * | 1/2012 | Potter | 160/127 |

* cited by examiner

*Primary Examiner* — Casandra Davis
(74) *Attorney, Agent, or Firm* — Thomas I. Rozsa

(57) ABSTRACT

An improved wet floor caution sign where the two panels of the sign are attached along a pair of adjacent sidewalls rather than at the top of the panels where conventional wet floor sign panels are attached. As a result, the two panels are ninety (90) degrees to each other and are therefore much more stabile. In addition, the ninety (90) degrees panel configuration facilitates having four panels on which advertisements can be placed as opposed to only two panels as in conventional signs.

9 Claims, 12 Drawing Sheets

WET FLOOR CAUTION SIGN

BACKGROUND OF THE INVENTION

1. Field of the Invention

The present invention relates to caution signs and more importantly, to caution signs which are placed at the location of wet floors to advise individuals to exercise caution in the area to so as not to slip and fall.

2. Description of the Prior Art

The inventors are only aware of the standard commercial wet floor caution sign which is shown in FIG. 1. Traditionally, the standard commercial wet floor caution sign is essentially a hinged apparatus 200 which consists of a first panel 210 and a second panel 220 which are retained together at their apex 230 by a hinge mechanism 240. The sign can be folded flat when not in use and when in use, the sign is opened up so that it is a generally upside down V-shaped structure as illustrated in FIG. 1 where the base of the sign base 210A and 220A rest against the floor 250. The sign has warnings on it such as "WET FLOOR" or "EXERCISE CAUTION AS FLOOR HAS RECENTLY BEEN MOPPED" or other comparable words to advise a pedestrian that the area where the sign has been placed has been recently mopped and is therefore wet and the pedestrian should avoid walking on that area or alternatively, walk very carefully so as to not slip and fall.

A further limitation of the wet floor caution sign is that there really is no room for advertising any products. Although each panel of the prior art has two sides, only the two outward facing sides of each panel is visible to pedestrians, and because these two outward facing panels necessarily facing opposite directions, there is no room for anything other than advising caution in each direction. There is a significant need for an improved caution sign which can utilize the interior and exterior facing panels of the sign.

An additional disadvantage is that the current upside-down V structure of the caution signs requires very careful placement of the sign, and very careful monitoring of the sign, so that it doesn't collapse and fall down flat on the ground creating further hazards or risks to pedestrians, children, or the workers who place such signs. The prior art is very sensitive and can fall down for a variety of reasons, including the vibrations of the floor caused by outside traffic, air conditioners, and the like, causing the sign to lose its grip and thus fall, the sign generally unable to prevent itself from slipping and sliding on the wet floor, and a pedestrian striding by the sign can cause the prior art caution signs to slip and fall. There is a significant need for an improved caution sign which is less frail and less sensitive to falling.

The prior art has an additional disadvantage in that it only has two legs to support and stabilize the sign. There is a significant need for an improved caution sign which has more legs and more stability. There is also a significant need for an improved caution sign which is not free to flop open and closed.

There is a significant need for an improved wet floor caution sign which has more panels on which advertising can be placed as well as more panels to caution pedestrians of the wet floor.

SUMMARY OF THE INVENTION

The present invention is an improved wet floor caution sign where the two panels of the sign are attached along a pair of adjacent sidewalls rather than at the top of the panels where conventional wet floor sign panels are attached. As a result, the two panels are ninety (90) degrees to each other and are therefore much more stabile. In addition, the ninety (90) degrees panel configuration facilitates having four panels on which advertisements can be placed as opposed to only two panels as in conventional signs.

It is therefore an object of the present invention to provide a wet floor caution sign where the two panels are attached along adjacent sides by rotation means and by a locking means. The sign rotates in the horizontal direction. As a result, the panel rests on four feet with the two panels at ninety degrees to each other making for a s far more stabile structure than conventional panels.

It is a further object of the present invention to provide a configuration for a wet floor sign where four panel faces are exposed to provide more advertising space.

It is a further object of the present invention to provide at least two separate unique closing mechanisms by which the two panels are forced to remain open and exposed and also facilitate closing the two panels so that they rest against each other.

The preferred embodiment of the opening and closing means operates in a unique manner, never before seen in the art. The present invention has two panels, a first panel and a second panel, however, unlike the prior art, the two panels are not hinged together at their tops, but instead, along one of their vertical sides. Also unlike the prior art, these two panels are not free to flop open and closed, but instead have a locking mechanism that controls the positions of the two panels relative to each other. The locking mechanism has cylindrical housing. At the top end of the cylindrical housing is located a button, and at the opposite end is a bottom collar. The bottom collar contains two notches. The present invention also has an engagement bar. The engagement bar is preferably comprised of a single rod having three generally right angles such that there are two portions of the rod that are horizontal and two portions of the rod that are vertical. The first vertical portion resides within the cylindrical housing and engages the button. There are many methods by which the engagement bar may engage the button, and is shown preferably engaged by a spring mechanism, the spring being attached to the underside of the button on one end and to the first vertical portion of the engagement rod at its other end. The first vertical portion of the engagement rod is followed by a first horizontal portion of the engagement rod. The first horizontal portion of the engagement rod exits the cylindrical housing at the bottom collar and engages with the two notches in the bottom collar, one notch at a time. The first notch is positioned such that when the first horizontal portion of the engagement bar is retained in the first notch, the two panels of the present invention are in a closed position. The second notch is positioned approximately 90-degrees clockwise from the first notch, so that when the first horizontal portion of the engagement bar is retained in the second notch, the two panels of the present invention are in the open position. The locking mechanism is affixed to the second panel, thus, the first vertical portion of the engagement rod is joined to the second panel by being within the cylindrical housing of the locking mechanism, the first horizontal portion goes between the second panel and the first panel, and the remaining portions of the engagement bar serve to connect to the first panel to the second panel by being retained in the retention means on the first panel. As the engagement rod moves from the first notch to the second notch, the first panel moves correspondingly and respectively from a closed position to an open position.

The first horizontal portion of the engagement bar moves from notch to notch and is retained therein as follows. Starting with the preferred embodiment of the present invention in the closed position, the first horizontal portion of the engagement bar is retained in the first notch and first panel and second panels are touching each other, in the closed position. The first vertical portion of the engagement bar is engaged by a tight spring to the underside of the button of the locking mechanism. To open the present invention, the button is depressed. Depressing the button, puts pressure on the spring within the cylindrical housing. Although the spring wants to deform, and does deform slightly, the spring is tight enough to transfer the downward force from depressing the button to the top of the vertical portion of the engagement bar. The engagement bar, when experiencing the downward force from the spring, may flex slightly, may flex the retention means on the first panel slightly, or both. There does not need to be a lot of movement, only enough downward movement on the first vertical portion of the engagement bar to result in the first horizontal portion of the engagement bar being pushed below the rim of the bottom collar of the cylindrical housing. Once the first horizontal portion of the engagement bar is below the rim of the bottom collar, the first panel is free to be moved by hand or swung over to the second notch. Once the first horizontal portion of the engagement bar has been moved away from the first notch, the user may release the button at any time, thus when the first horizontal portion of the engagement bar reaches the second notch, the first horizontal portion of the engagement bar is pulled up into the second notch and is retained there. This is because the top of the first vertical portion of the engagement bar is no longer experiencing a downward force, and being attached to the spring, which in turn is attached to the underside of the button, is no longer displaced and therefore is forced by the spring to return to its original vertical position, and the present invention is "locked" into an open position. The process to close the present invention is nearly identical, the difference being the moving of or the swinging of the first horizontal portion of the engagement bar from the second notch back to the first notch, whereupon the engagement bar is again pulled up into the first notch and is releasably "locked" in that position.

The second embodiment works in a very similar manner. The second embodiment has two panels, a first panel and a second panel that are hingeably attached along one of their vertical sides. The second embodiment has a locking mechanism that controls the positions of the two panels relative to each other. The locking mechanism has two housings, an upper cylindrical housing affixed to the second panel and a lower housing affixed to the first panel. At the top end of the upper cylindrical housing is located a button, and at the opposite end is a bottom collar. The bottom collar contains two notches. The second housing abuts the side of the first panel and has a small nipple residing on its upper surface, near the perimeter thereof, and is located and sized to fit within the notches on the bottom collar of the first housing. Residing within both the first housing and the second housing is an engagement rod, having a first end and a second end. The first end of the engagement rod resides within the first housing and is attached by spring to the underside of the button. The second end of the engagement rod resides within the second housing and is non-rotationally fixed therein. In other words, the engagement rod is affixed to the second housing in such a manner that it can freely rotate within the first housing and does not freely rotate within the second housing, and as the engagement rod moves, so does the first panel, without affecting movement on the second panel.

With regard to the two notches of the second embodiment, the first notch is positioned such that when the nipple on the second housing is retained in the first notch, the two panels of the present invention are in a closed position. The second notch is positioned approximately 90-degrees clockwise from the first notch, so that when the nipple on the second housing is retained in the second notch, the two panels of the present invention are in the open position.

The second embodiment opens and closes in the following manner. Starting with the second embodiment of the present invention in the closed position, the nipple on the second housing is retained in the first notch, and first panel and second panels are touching each other, in the closed position. The first end of the engagement bar is engaged by a tight spring to the underside of the button of the locking mechanism. To open the present invention, the button is depressed. Depressing the button, puts pressure on the spring within the first housing. Although the spring wants to deform, and does deform slightly, the spring is tight enough to transfer the downward force from depressing the button to the top of the first end of the engagement bar. The engagement bar, when experiencing the downward force from the spring, moves correspondingly downwards, and the first panel may flex slightly, the hinges on the side may flex slightly, or both. There does not need to be a lot of movement, only enough downward movement on the first end of the engagement bar to result in the first panel being pushed downwardly so that the nipple disengages the first notch and is pushed below the rim of the bottom collar of the first housing. Once nipple is below the rim of the bottom collar, the first panel is free to be moved by hand or swung over to the second notch. Once the first horizontal portion of the engagement bar has been moved away from the first notch, the user may release the button at any time, thus when the nipple reaches the second notch, the nipple is pulled up into the second notch and is retained there. This is because the top of the first vertical portion of the engagement bar is no longer experiencing a downward force, and being attached to the spring, which in turn is attached to the underside of the button, is no longer displaced and therefore is forced by the spring to return to its original vertical position, and the present invention is "locked" into an open position. The process to close the present invention is nearly identical, the difference being the moving of or the swinging of the nipple from the second notch back to the first notch, whereupon the engagement bar is again pulled up into the first notch and the nipple is releasably "locked" in that position.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 2-5, there is illustrated front elevational and rear elevational views of the wet floor caution sign in the closed condition and perspective views of the wet floor caution sign in the open condition, both looking from the exterior and from the interior.

Figure 1:
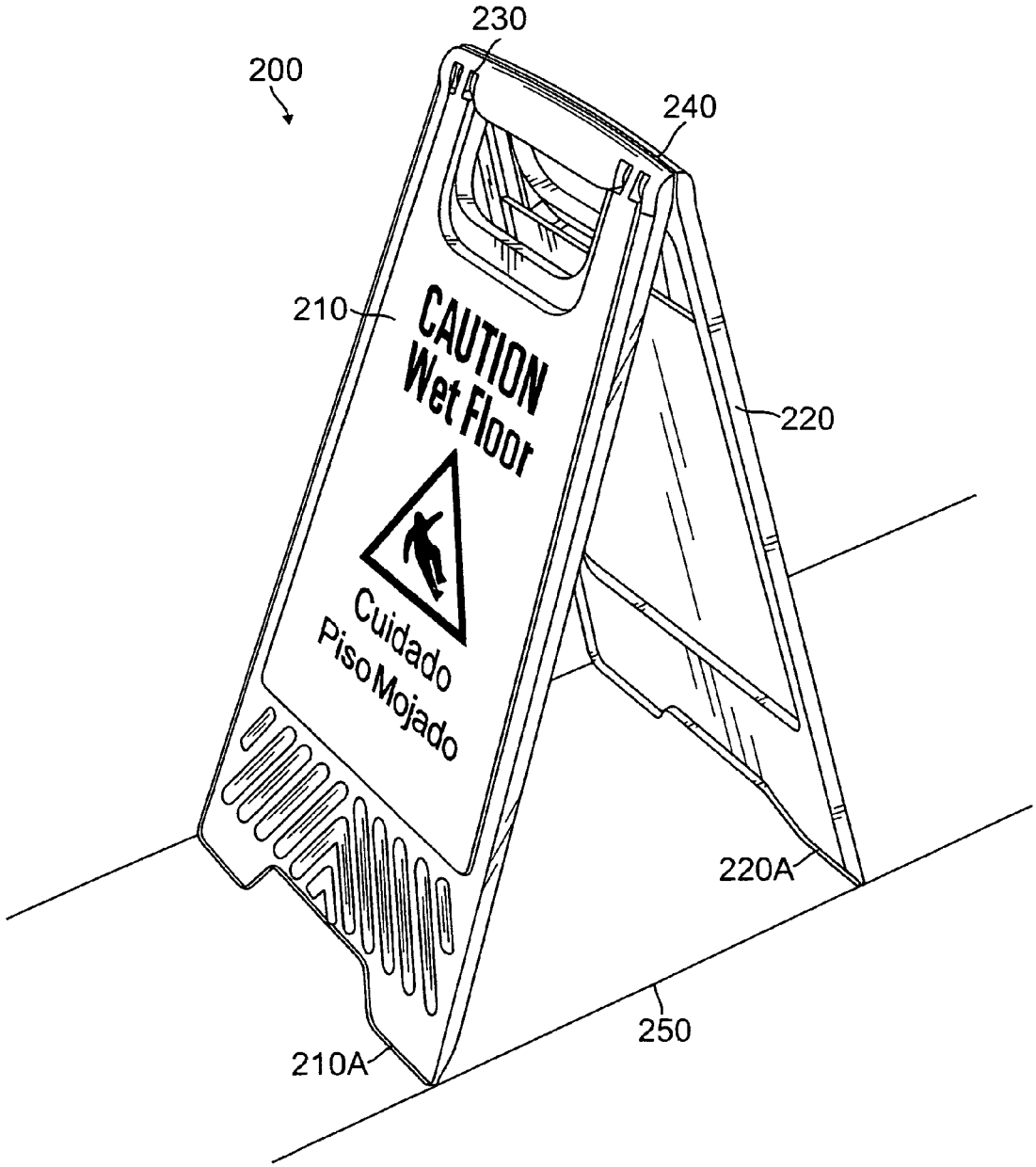
FIG. 1 (PRIOR ART)
FIG. 1 is a perspective view of the conventional prior art wet floor caution sign.
Figure 2:
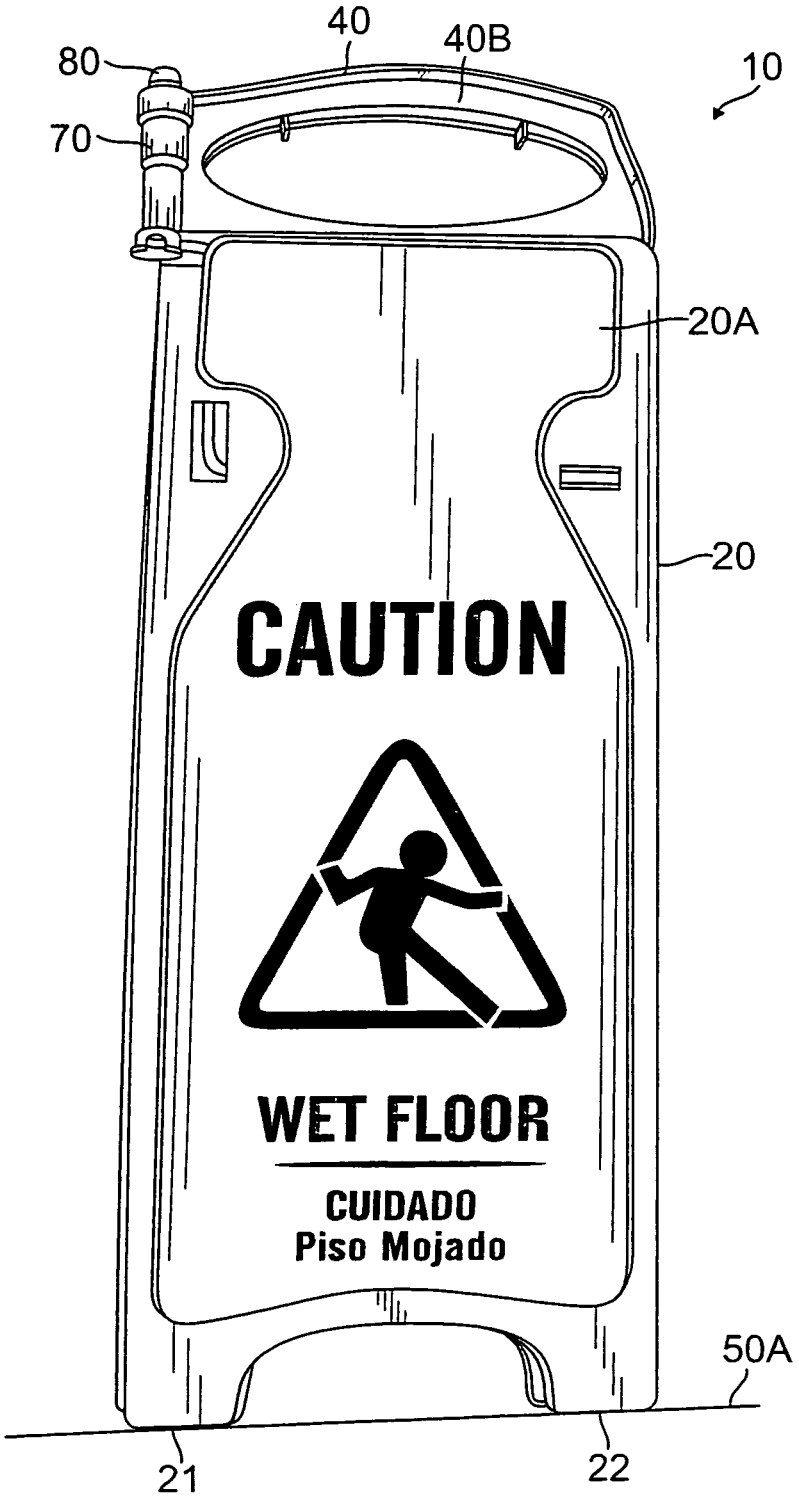
FIG. 2 is a front elevational view of a preferred embodiment of the present invention wet floor caution sign when viewed in the closed condition illustrating the smaller section of the panel folded against the larger section of the panel.
Figure 3:
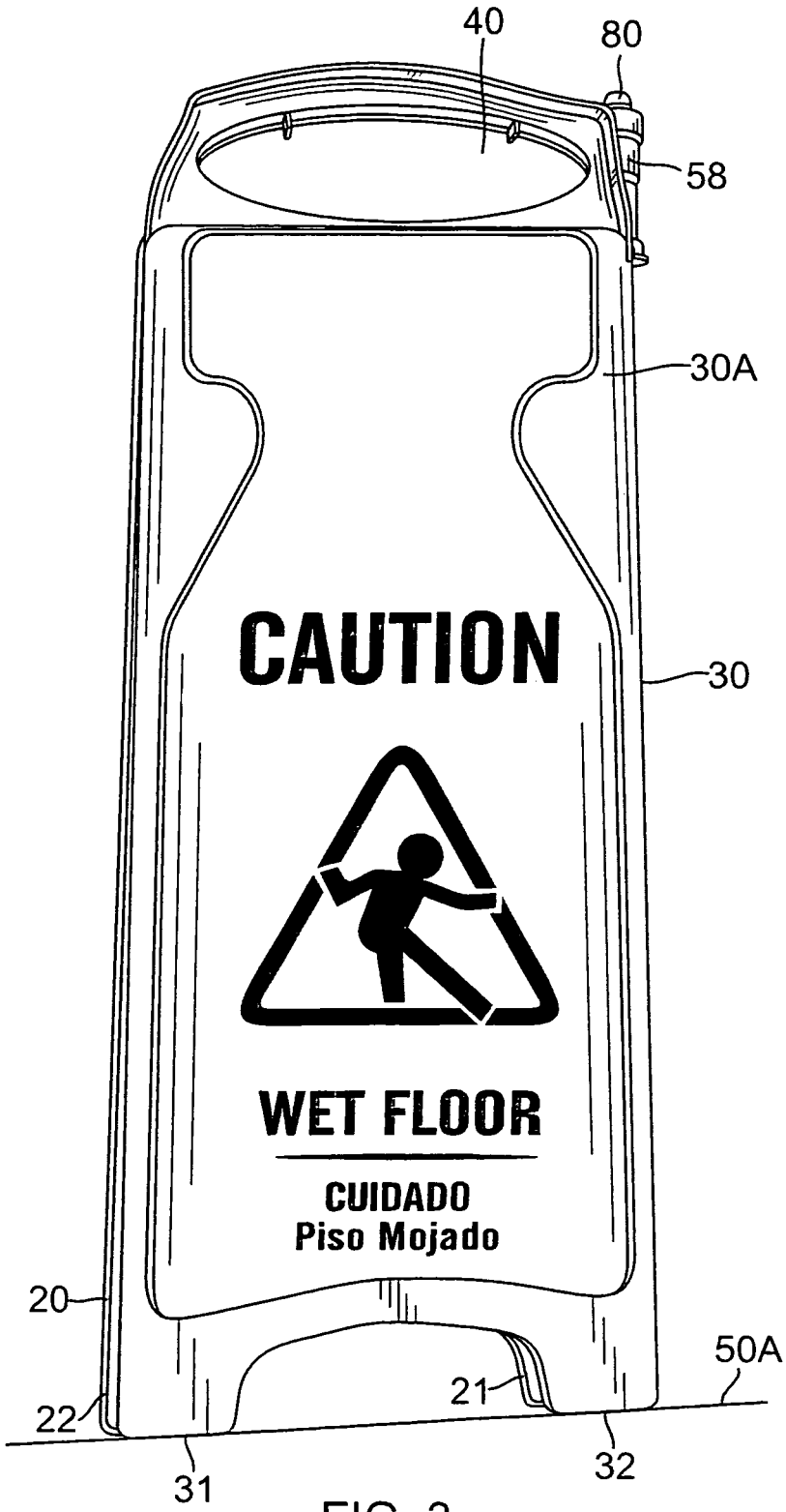
FIG. 3 is a rear elevational view of the preferred embodiment of the present invention wet floor caution sign showing the larger panel in the closed condition.

Referring to FIGS. 2 and 3, the wet floor caution sign 10 consists of a first panel 20 which has a pair of feet 21 and 22 which rest against the floor 50A. The panel itself can have any design in addition to the design as illustrated. The panel can also have silkscreened thereon wording such as "CAUTION" with a person in a triangle and the words "WET FLOOR" beneath it.

Referring to FIG. 3, the wet floor caution sign has a second panel 30 larger than first panel 20 which has a pair of feet 31 and 32 which rest on floor 50A. The second panel 30 also has a hand grip opening 40 by which the sign can be grasped by a hand and carried from one location to another. The two panels 20 and 30 are retained together at the upper location by a spring actuated mechanism 58 which will be discussed in detail below.

Figure 4:
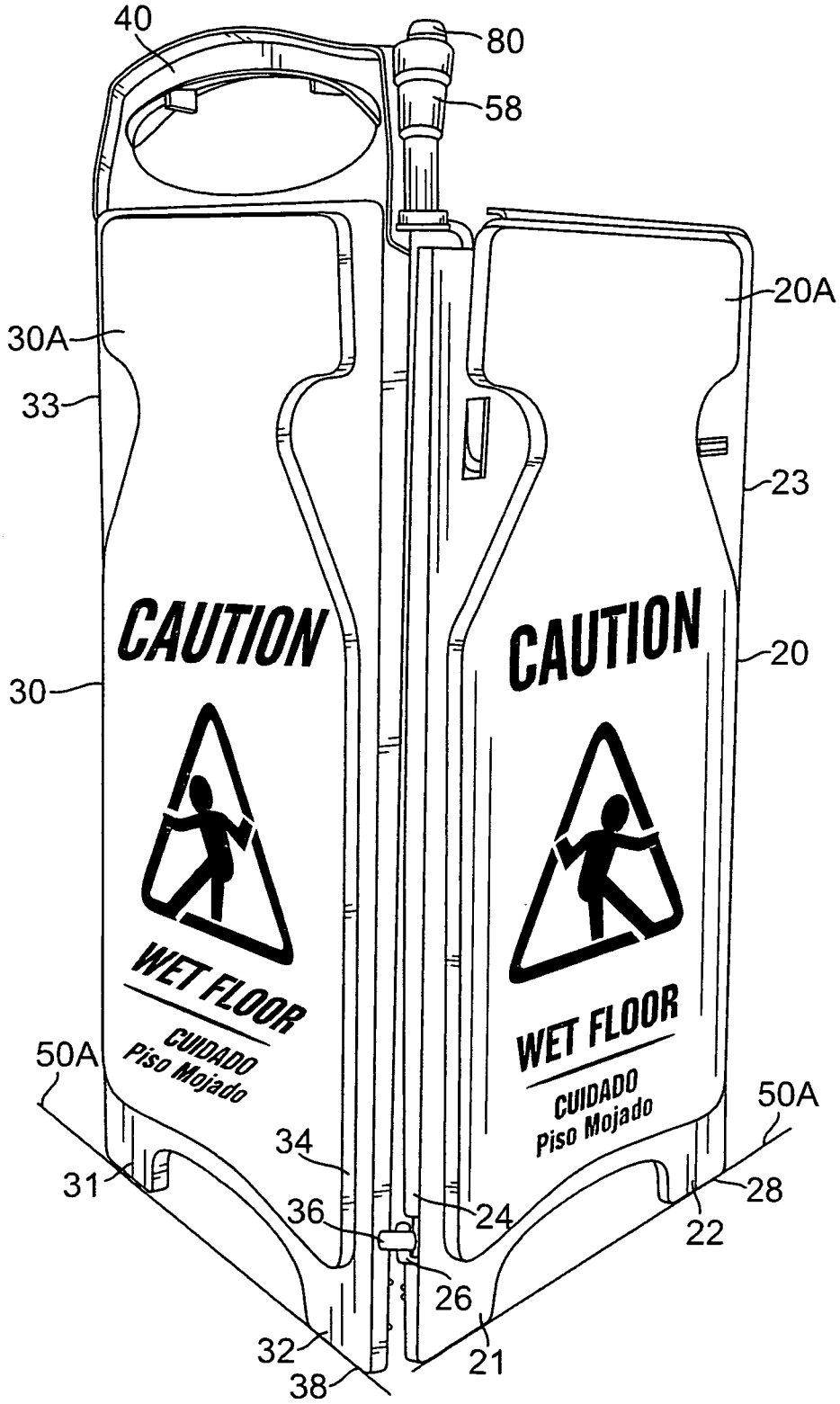
FIG. 4 is an exterior perspective view showing the preferred embodiment of the wet floor caution sign in the open condition.

Referring to FIG. 4, the present invention wet floor caution sign 10 is shown in the open condition from the rear view. The two panels 20 and 30 are at approximately 90 degrees to each other and the feet rest against the floor 50A so that the two panels are at a 90 degree angle separated by the interlocking mechanism which will be discussed below.

Figure 5:
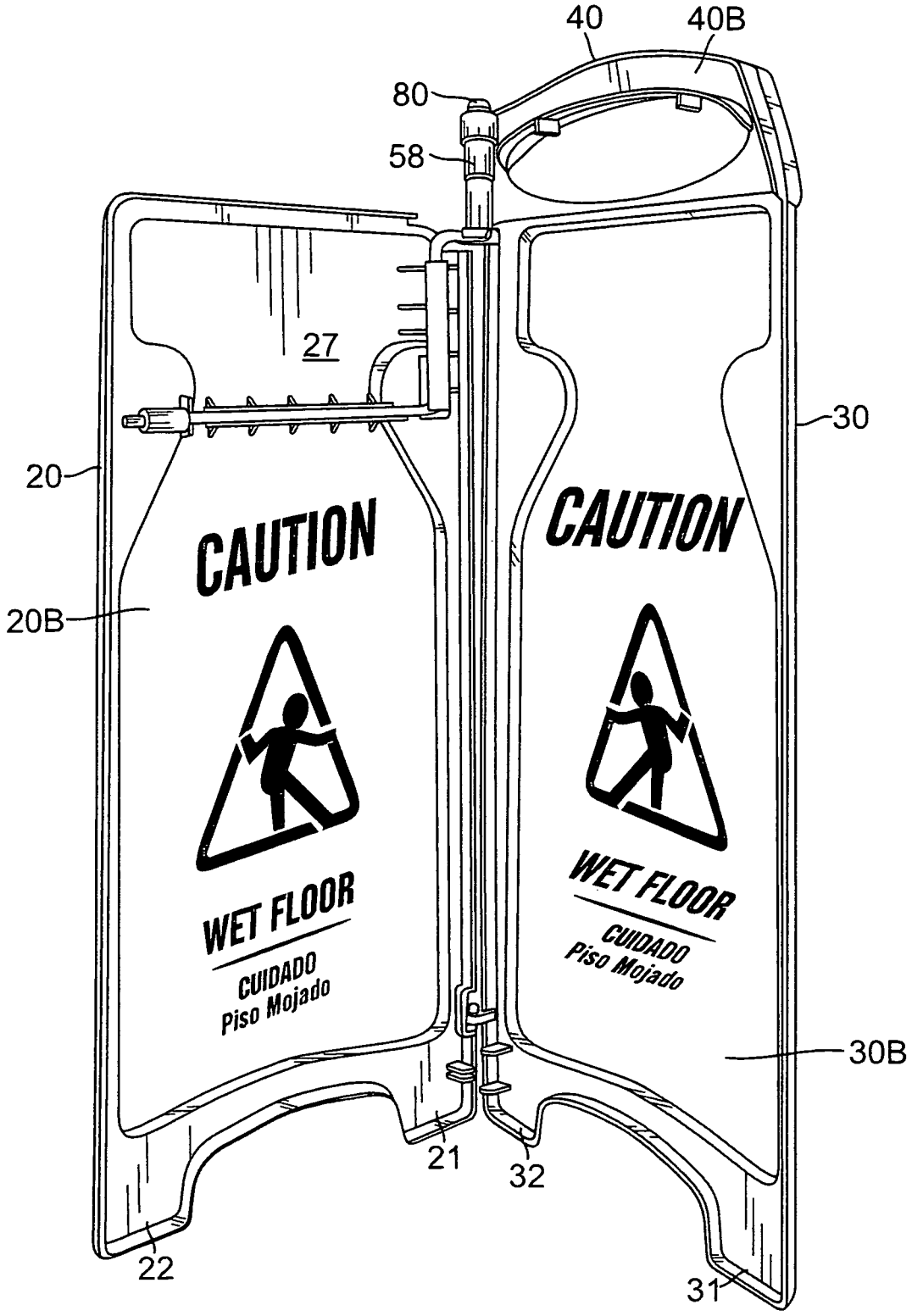
FIG. 5 is a perspective view showing the interior of the preferred embodiment of the wet floor caution sign in the open condition.

Referring to FIG. 4. there is shown the exterior view of the wet floor caution sign wherein the two panels are at 90 degrees to each other. Advertising 20AA and 30AA can be placed on each of the exterior panels 20A and 30A in addition to the customary warning information. Referring to FIG. 5, there is shown the interior view of the wet floor caution sign wherein again the two panels are at 90 degrees to each other. Advertising 20BB and 30*bb* can be placed on each of the interior panels numbered 20B and 30B. Also cautionary wording can be placed. The benefit of this invention is that rather than having two panels that are viewable from the outside, the sign has four panels, both the inside and the outside of each section 20 and 30, wherein advertising and/or cautionary information can be placed.

Panel 20 has a distal side edge 23 and proximal side edge 24. Proximal side edge 24 contains a post 26 adjacent its lower end 28. Panel 30 has a distal side edge 33 and a proximal side edge 34. Proximal side edge 34 has collar 36 adjacent its lower end 38. Proximal side edges 26 and 36 are adjacent to each other. Collar 36 rotatably fits over post 26 and provides the rotatable opening and closing means at the bottom for the sign 10. It will be appreciated that other combinations of rotatable opening and closing means are within the spirit and scope of the present invention and the purpose of the rotatable opening and closing means adjacent the bottom of the sign 10 is to provide a balance at the bottom of the sign as the primary opening and closing means is the locking mechanism adjacent the top of the sign.

Figure 6A:
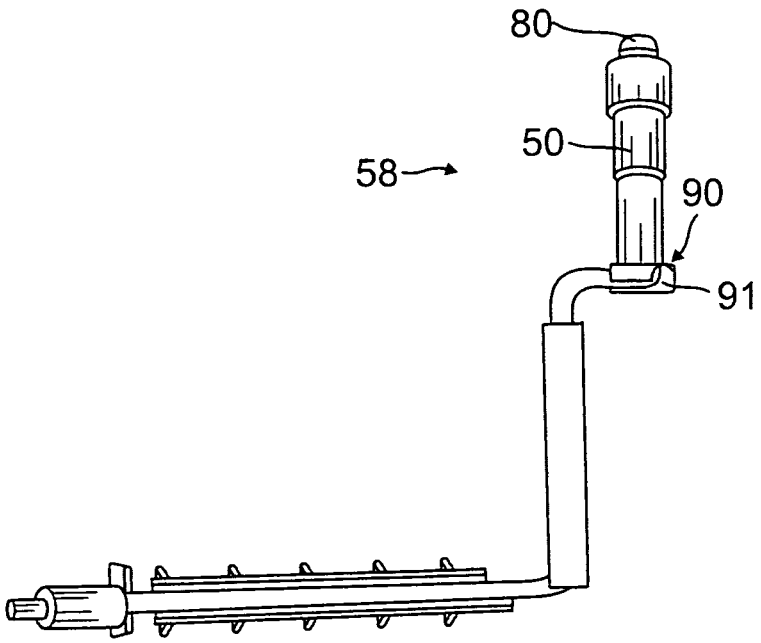
FIG. 6A is a perspective view of the retention mechanism which retains the wet floor sign in the open condition.
Figure 6B:
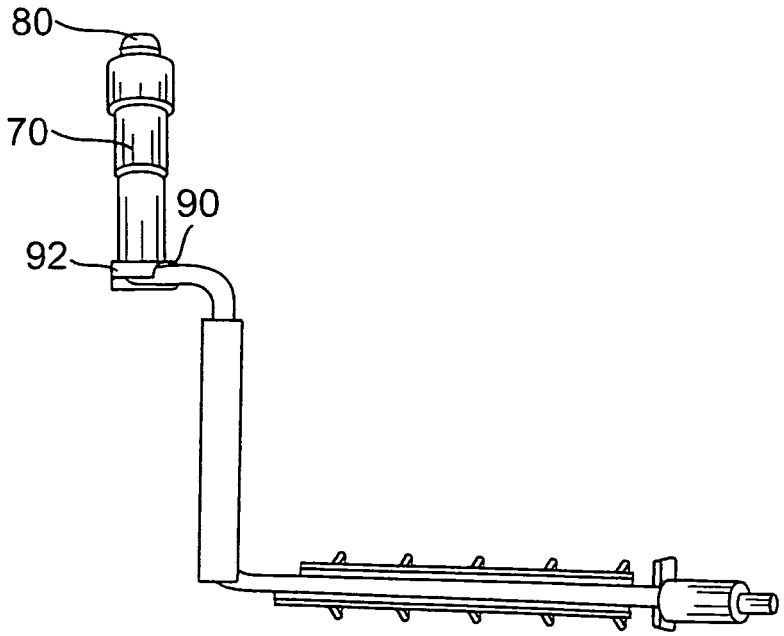
FIG. 6B is a perspective view of the retention mechanism which retains the wet floor sign in the closed condition.

The unique locking mechanism provides the rotatable opening closing means for the sign 10. The primary opening and closing meas for the sign by which it is opened and closed is by an actuated pushbutton mechanism which is shown in FIGS. 6A and 6B.

Figure 7:
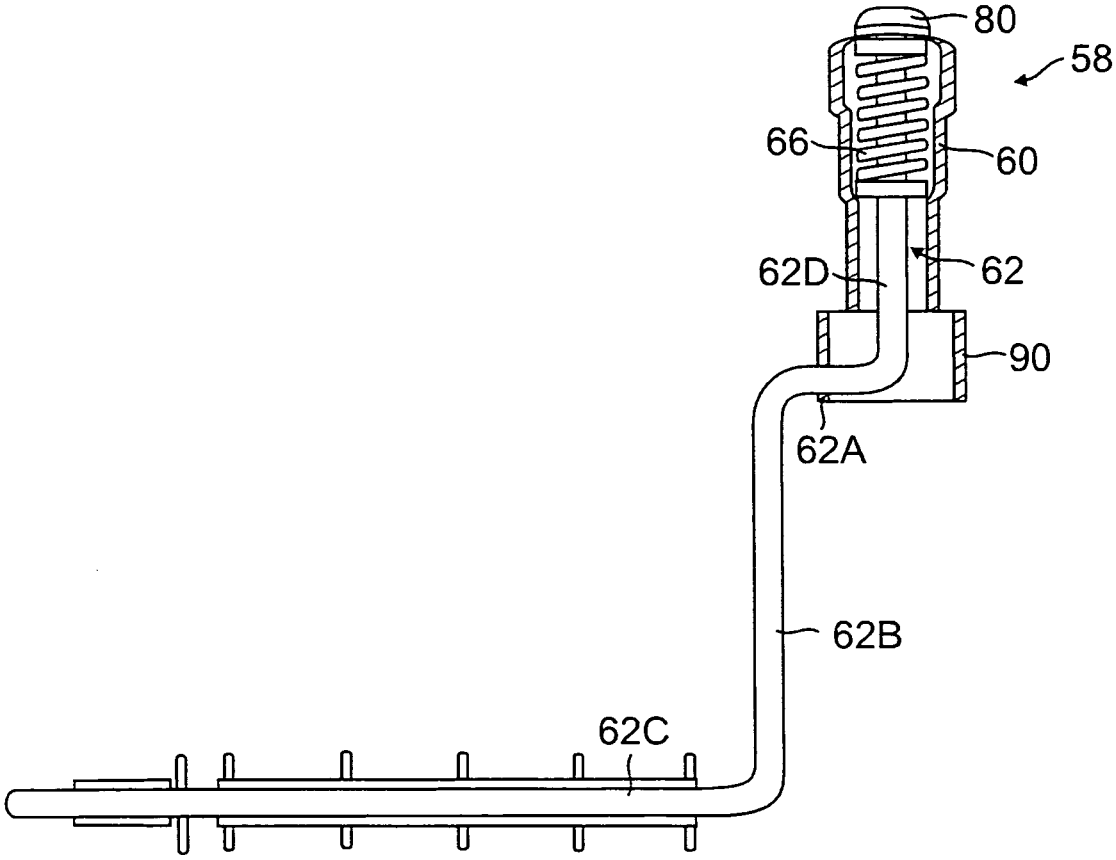
FIG. 7 is a cross-sectional view illustrating the interior spring mechanism of the we floor caution sign.

The preferred embodiment operates in a unique manner, never before seen in the art. Referring to FIG. 7, the present invention has two panels, a first panel 20 and a second panel 30, however, unlike the prior art, the two panels are not hinged together at their tops, but instead, are rotatable affixed along one of their vertical sides. Also unlike the prior art, these two panels are not free to flop open and closed, but instead have a locking mechanism 58 that controls the positions of the two panels relative to each other. The locking mechanism 58 has cylindrical housing 60. At the top end of the cylindrical housing 60 is located a button 80, and at the opposite end is a bottom collar 90. The bottom collar 90 contains two notches 91 and 92. The present invention also has an engagement bar 62. The engagement bar 62 is preferably comprised of a single rod having four sections divided by generally right angles 62A, 62B, 62C and 62D such that there are two portions of the rod 62A and 62C that are horizontal and two portions of the rod 62B and 62D that are vertical. The first vertical portion 62D resides within the cylindrical housing 60 and engages the button 80. There are many methods by which the engagement bar may engage the button, and is shown preferably engaged by a spring mechanism 66, the spring being attached to the underside of the button 80 on one end and to the first vertical portion 62D of the engagement rod at its other end. The first vertical portion of the engagement rod 62D is followed by a first horizontal portion of the engagement rod 62A. The first horizontal portion of the engagement rod exits the cylindrical housing 60 at the bottom collar 90 and engages with the two notches 91 and 92 in the bottom collar 90, one notch at a time. The first notch 91 is positioned such that when the first horizontal portion of the engagement bar 62A is retained in the first notch 91, the two panels of the present invention 20 and 30 are in a closed position. The second notch 92 is positioned approximately 90-degrees clockwise from the first notch 91, so that when the first horizontal portion of the engagement bar 62A is retained in the second notch 92, the two panels 20 and 30 of the present invention are in the open position. The locking mechanism 58 is affixed to the second panel 30, thus, the first vertical portion of the engagement rod 62D is joined to the second panel 30 by being within the cylindrical housing 60 of the locking mechanism 58, the first horizontal portion 62A goes between the second panel 30 and the first panel 20, and the remaining portions of the engagement bar serve to connect to the first panel to the second panel by being retained in the retention means 27 on the first panel 20. As the engagement rod moves from the first notch 91 to the second notch 92, the first panel 20 moves correspondingly and respectively from a closed position to an open position.

The first horizontal portion of the engagement bar 62A moves from notch to notch and is retained therein as follows. Starting with the preferred embodiment of the present invention in the closed position, the first horizontal portion of the engagement bar 62A is retained in the first notch 91 and first panel 20 and second panel 30 are touching each other, in the closed position. The first vertical portion of the engagement bar 62D is engaged by a tight spring 66 to the underside of the button 80 of the locking mechanism 58. To open the present invention, the button 80 is depressed. Depressing the button 80, puts pressure on the spring 66 within the cylindrical housing 60. Although the spring 66 wants to deform, and does deform slightly, the spring 66 is tight enough to transfer the downward force from depressing the button 80 to the top of the vertical portion of the engagement bar 62D. The engagement bar 62, when experiencing the downward force from the spring 66, may flex slightly, may flex the retention means 26 and 36 on the first panel 20 slightly, or both. There does not need to be a lot of movement, only enough downward movement on the first vertical portion of the engagement bar 62D to result in the first horizontal portion of the engagement bar 62A being pushed below the rim of the bottom collar 91 of the cylindrical housing 60. Once the first horizontal portion of the engagement bar 62A is below the rim of the bottom collar 91, the first panel 20 is free to be moved by hand or swung over to the second notch 92. Once the first horizontal portion of the engagement bar 62A has been moved away from the first notch 91, the user may release the button 80 at any time, thus when the first horizontal portion of the engagement bar 62A reaches the second notch 92, the first horizontal portion of the engagement bar 62A is pulled up into the second notch 92 and is retained there. This is because the top of the first vertical portion of the engagement bar 62D is no longer experiencing a downward force, and being attached to the spring 66, which in turn is attached to the underside of the button 80, is no longer displaced and therefore is forced by the spring 66 to return to its original vertical position, and the present invention is "locked" into an open position. The process to close the present invention is nearly identical, the difference being the moving of or the swinging of the first horizontal portion of the engagement bar 62A from the second notch 92 back to the first notch 91, whereupon the engagement bar is again pulled up into the first notch 91 and is releasably "locked" in that position.

Referring to FIGS. 8-11, there is illustrated front elevational and rear elevational views of an alternative embodiment of the wet floor caution sign in the closed condition and perspective views of the wet floor caution sign in the open condition, both looking from the exterior and from the interior.

Figure 8:
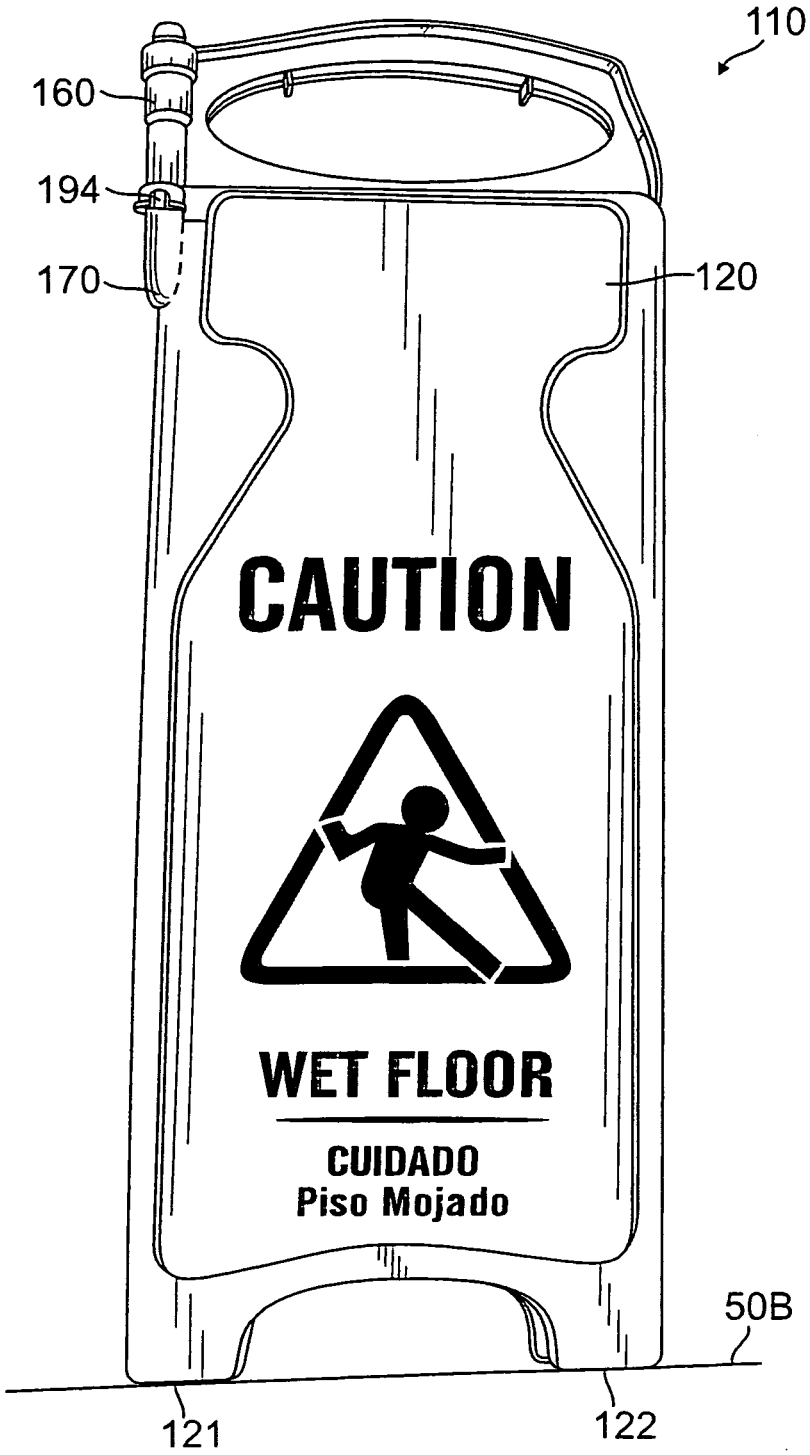
FIG. 8 is a front elevational view of an alternative embodiment of the present invention wet floor caution sign when viewed in the closed condition illustrating the smaller section of the panel folded against the larger section of the panel.
Figure 9:
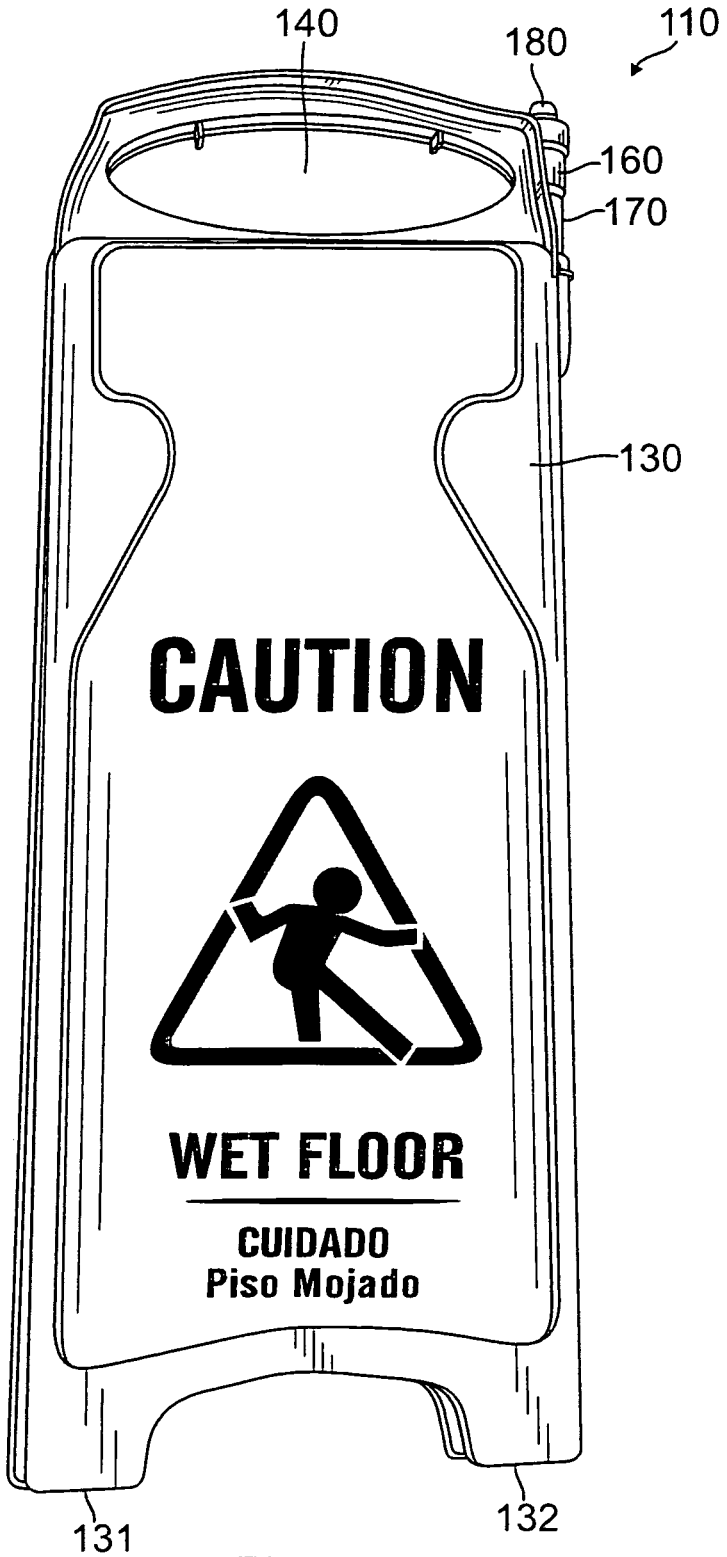
FIG. 9 is a rear elevational view of the alternative embodiment of the present invention wet floor caution sign showing the larger panel in the closed condition.

Referring to FIGS. 8 and 9, the wet floor caution sign 110 consists of a first panel 120 which has a pair of feet 121 and 122 which rest against the floor 50B. The panel itself can have any design in addition to the design as illustrated. The panel can also have silkscreened thereon wording such as "CAUTION" with a person in a triangle and the words "WET FLOOR" beneath it.

Referring to FIG. 9, the wet floor caution sign has a second panel 130 larger than first panel 120 which has a pair of feet 131 and 132. The second panel 130 also has a hand grip opening 140 by which the sign can be grasped by a hand and carried from one location to another. Panel 120 has a distal side edge 123 and a proximal side edge 124. Proximal side edge 124 contains a post 126 adjacent to its lower end 128. Panel 130 has a distal side edge 133 and a proximal side edge 134. Proximal side edge 134 has a collar 136 adjacent its lower end 138. Proximal side edges 126 and 136 are adjacent to each other. Collar 136 rotatably fits over post 126 and provides a rotatable opening and closing means at the bottom for the sign 110. It will be appreciated that other combinations of rotatable opening and closing means are within the spirit and scope of the present invention and the purpose of the rotatable opening and closing means adjacent the bottom of the sign is to provide a balance at the bottom of the sign.

The primary opening and closing means is a locking mechanism adjacent the top of the sign. The two panels 120 and 130 are retained together at the upper location by a spring actuated mechanism 158 which will be discussed in detail below.

Figure 10:
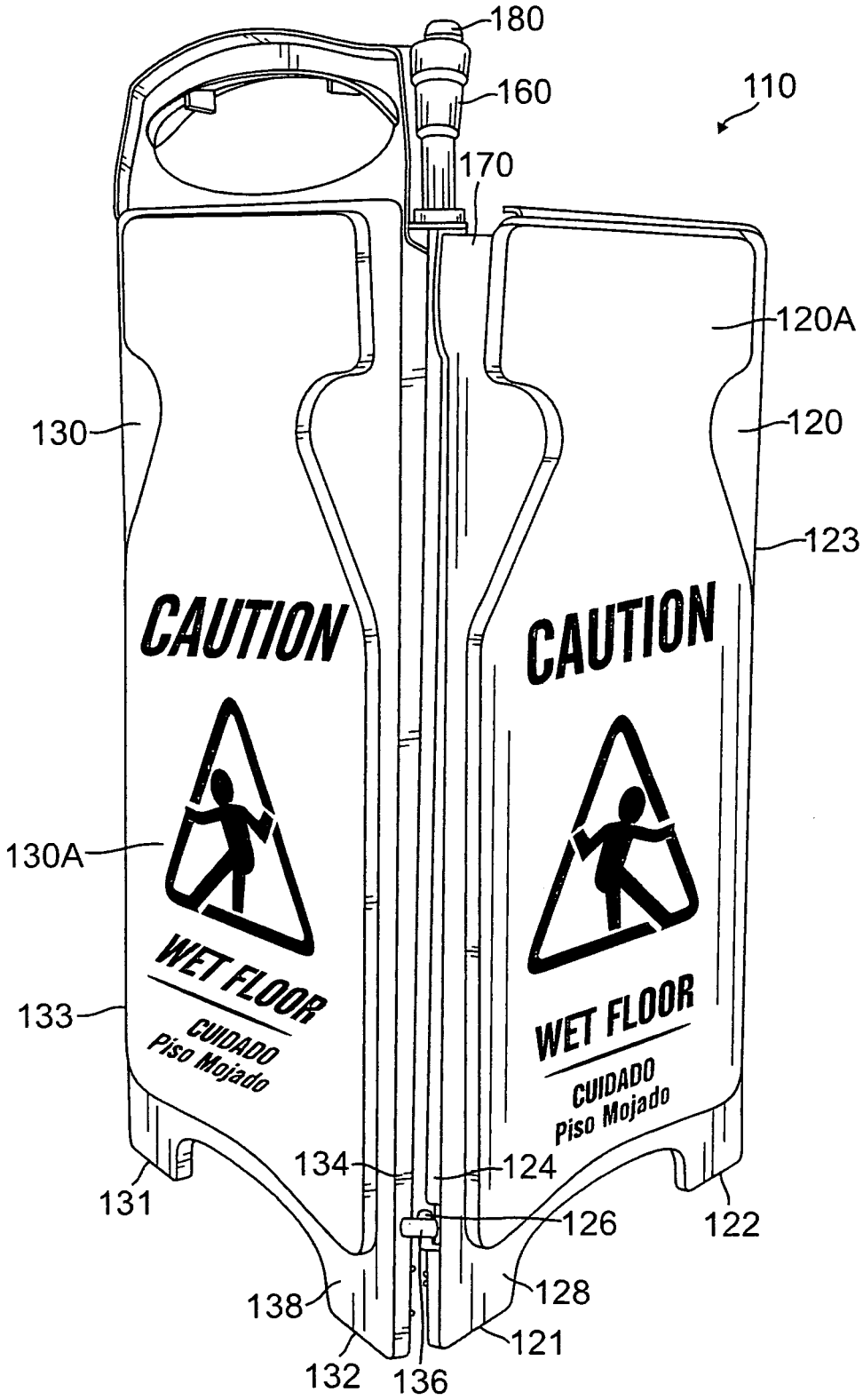
FIG. 10 is an exterior perspective view showing the alternative embodiment of the wet floor caution sign in the open condition.

Referring to FIG. 10, the present invention wet floor caution sign 110 is shown in the open condition from the rear view. The two panels 120 and 130 are at approximately 90 degrees to each other and the feet rest against the floor so that the two panels are at a 90 degree angle separated by the interlocking mechanism which will be discussed below.

Figure 11:
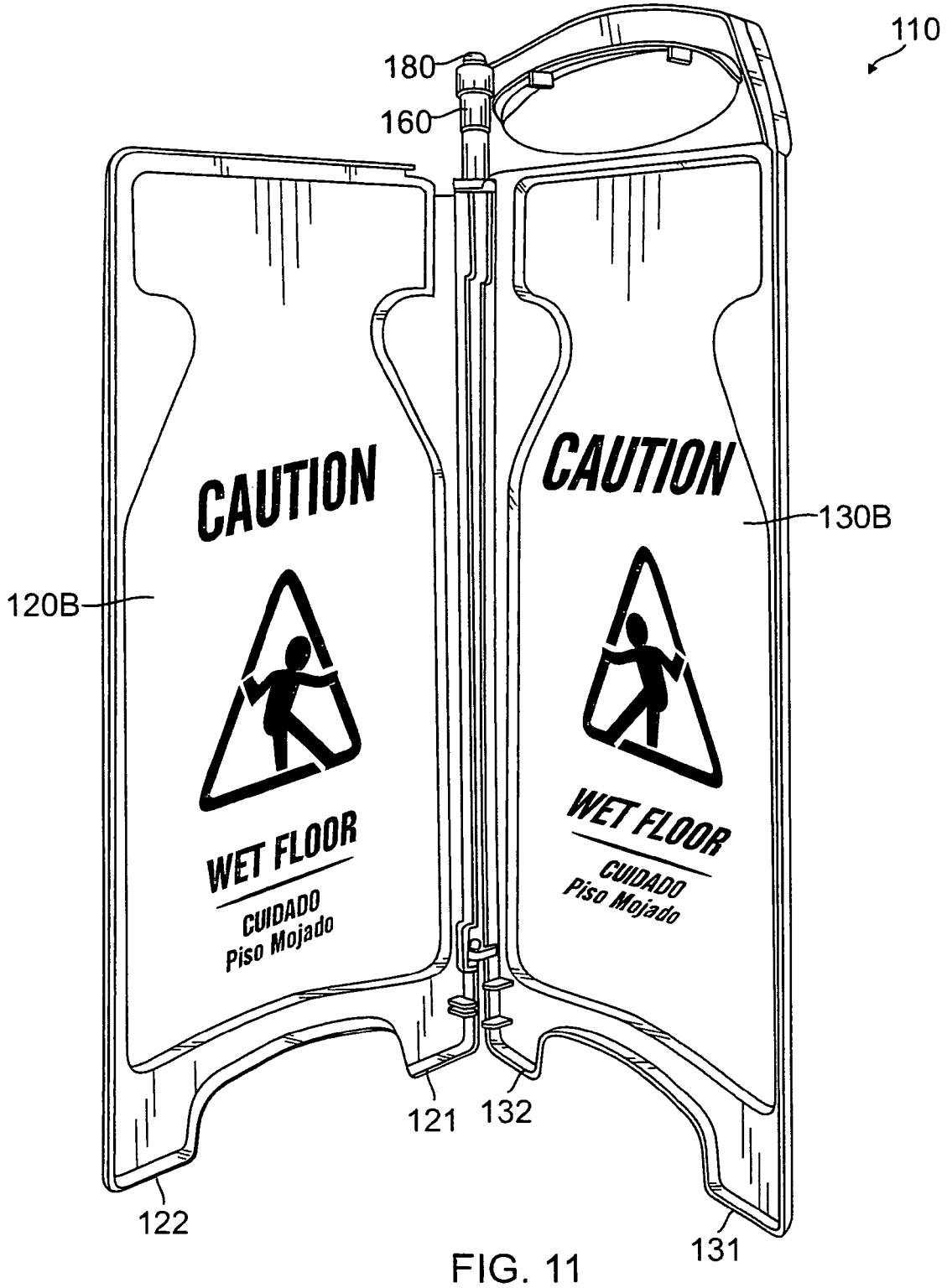
FIG. 11 is a perspective view showing the interior of the alternative embodiment of the wet floor caution sign in the open condition.
Figure 12A:
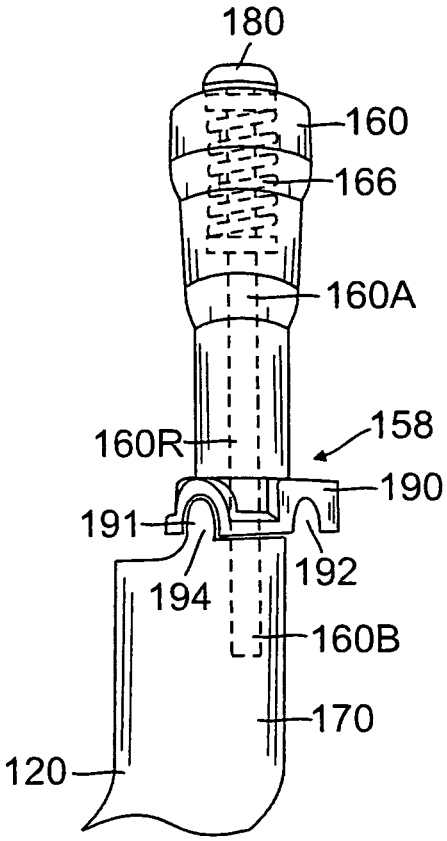
FIG. 12A is a perspective view of the alternative embodiment of the retention mechanism which retains the wet floor sign in the open condition.
Figure 12B:
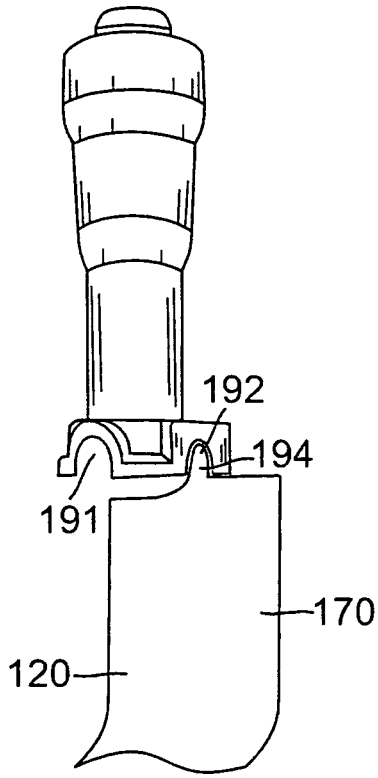
FIG. 12B is a perspective view of the alternative embodiment of the retention mechanism which retains the wet floor sign in the closed condition.

Referring to FIG. 10, there is shown the exterior view of the wet floor caution sign wherein the two panels are at 90 degrees to each other. Advertising can be placed on each of the exterior panels 120A and 130A in addition to the customary warning information. Referring to FIG. 11, there is shown the interior view of the wet floor caution sign wherein again the two panels are at 90 degrees to each other. Advertising can be placed on each of the interior panels numbered 120B and 130B. Also cautionary wording can be placed. The benefit of this invention is that rather than having two panels that are viewable from the outside, the sign has four panels, both the inside and the outside of each section 120 and 130, wherein advertising and/or cautionary information can be placed The sign is opened and closed by an actuated pushbutton mechanism which is shown in FIGS. 12A and 12B.

The second embodiment works in a very similar manner. The second embodiment has two panels, a first panel 120 and a second panel 130 that are rotatably attached along one of their vertical sides. The lower rotatable mechanism with the post and collar is the same as the first mechanism. The second embodiment has a locking mechanism 158 that controls the positions of the two panels relative to each other. The locking mechanism 158 has two housings, an upper housing 160 affixed to the second panel 130 and a lower housing 170 affixed to the first panel 120. At the top end of the upper housing 160 is located a button 180, and at the opposite end is a bottom collar 190. The bottom collar 190 contains two notches 191 and 192. The second housing 170 abuts the side of the first panel 120 and has a small nipple 194 residing on its upper surface, near the perimeter thereof, and is located and sized to fit within the notches 191 and 192 on the bottom collar 190 of the first housing. Residing within both the first housing and the second housing is an engagement rod, 160R having a first end 160A and a second end 160B. The first end 160A of the engagement rod 160R resides within the first housing 160 and is attached by spring 166 to the underside of the button 180. The second end 160B of the engagement rod 160R resides within the second housing 170 and is preferably non-rotationally fixed therein. In other words, the engagement rod 160R is affixed to the second housing 160B in such a manner that it can freely rotate within the first housing 160 and does not freely rotate within the second housing 170, and as the engagement rod moves, so does the first panel 120, without affecting movement on the second panel 130.

With regard to the two notches 191 and 192 of the second embodiment, the first notch 191 is positioned such that when the nipple 194 on the second housing 170 is retained in the first notch 192, the two panels 120 and 130 of the present invention are in a closed position. The second notch 191 is positioned approximately 90-degrees clockwise from the first notch 192, so that when the nipple 194 on the second housing 170 is retained in the second notch 191, the two panels 120 and 130 of the present invention are in the open position.

The second embodiment 110 opens and closes in the following manner. Starting with the second embodiment 110 of the present invention in the closed position, the nipple 194 on the second housing is retained in the first notch 192, and first panel 120 and second panel 130 are touching each other, in the closed position. The first end of the engagement bar 160A is engaged by a tight spring 166 to the underside of the button 180 of the locking mechanism 158. To open the present invention, the button 180 is depressed. Depressing the button 180 puts pressure on the spring 166 within the first housing 160. Although the spring 166 wants to deform, and does deform slightly, the spring 166 is tight enough to transfer the downward force from depressing the button 180 to the top of the first end 160A of the engagement bar 160R. The engagement rod 160B, when experiencing the downward force from the spring 166, moves correspondingly downwards, and the first panel 120 may flex slightly, the hinges on the side may flex slightly, or both. There does not need to be a lot of movement, only enough downward movement on the first end 160A of the engagement rod 160R to result in the first panel 120 being pushed downwardly so that the nipple 194 disengages the first notch 192 and is pushed below the rim of the bottom collar 190 of the first housing 160. Once nipple 194 is below the rim of the bottom collar 190, the first panel 120 is free to be moved by hand or swung over to the second notch 192. Once the nipple 194 has been moved away from the first notch 192, the user may release the button 180 at any time, thus when the nipple 194 reaches the second notch 191, the nipple 194 is pulled up into the second notch 192 and is retained there. This is because the top of the first vertical portion of the engagement rod 160A is no longer experiencing a downward force, and being attached to the spring 166, which in turn is attached to the underside of the button 180, is no longer displaced and therefore is forced by the spring 166 to return to its original vertical position, and the present invention is "locked" into an open position. The process to close the present invention is nearly identical, the difference being the moving of or the swinging of the nipple 194 from the second notch 191 back to the first notch 192, whereupon the engagement rod 160R is again pulled up into the first notch 192 and the nipple 194 is releasably "locked" in that position.

The present invention wet floor caution sign is a significant improvement over the prior art in that it provides for a much more stable structure where the two panels are intersecting 90 degrees to each other and the sign has four sides on which advertising or cautionary information can be displayed. In addition, the sign is much easier to carry in that there is a handle member molded into one of the two sections so that when the wet floor caution sign is folded flat as illustrated in FIGS. 2 and 3, the sign can be carried by hand and when it is desired to have the sign in the open and activated condition, the pushbutton 80 is pushed down to overcome the force of the spring force 72 so that the interlocking mechanism 90 can be activated and retain the two panels 20 and 30 at 90 degrees to each other with their respective feet 21, 22, 31 and 32 resting against the floor where there is a wet location.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A wet floor caution sign placed on a floor, comprising:

a. a first panel which has a pair of feet adjacent a lower end, the first panel having two panel faces on opposite sides of the first panel onto which warning information and advertising is placed, a second panel which is taller than first panel and which has a pair of feet adjacent a lower end, the second panel having a hand grip opening by which the sign is be grasped by a hand and carried from one location to another; the second panel having two panel faces on opposite sides of the second panel; onto which warning information and advertising is placed thereby providing four panel faces onto which warning information and advertising is placed;

b. the first panel has a distal side edge and a proximal side edge, the second panel has a distal side edge and a proximal side edge, the proximal side edges of the first and second panels are adjacent to each other, the proximal side edge of one panel containing a post adjacent its lower end and the proximal side edge of the other panel containing a collar which rotatably fits over the post, the combination post and collar providing a rotatable opening and closing means adjacent the bottom for the sign;

c. a spring actuated locking means located adjacent a top end of the proximal side edges of the first and second panels, the spring actuated locking means causing the two panels to be positioned at ninety degrees to each other when the sign is in the opened condition so that four panel faces are visible when the sign is placed of a floor, the spring actuated locking mechanism enabling the two panels to rest adjacent one another when the sign is in the closed condition;

d. a locking mechanism that controls the positions of the first and second panels relative to each other, the locking mechanism having a cylindrical housing, at a top end of the cylindrical housing is located a button, and at an opposite end of the cylindrical housing is a bottom collar, the bottom collar containing a first notch and a second notch; and e. an engagement bar comprised of a single rod having four sections which are generally right angle sections such that there are two sections of the rod are horizontally aligned and two sections of the rod that are vertically aligned, a first vertical section resides within the cylindrical housing and engages the button by a spring mechanism of the spring activated locking means, the spring mechanism being attached to an underside of the button on one end and to the first vertical section of the engagement bar at its other end, the first vertical section is followed by a first horizontal section of the engagement bar, the first horizontal section of the engagement bar exits the cylindrical housing at the bottom collar and engages with the two notches in the bottom collar, one notch at a time, the first notch is positioned such that when the first horizontal portion of the engagement bar is retained in the first notch, the two panels of the sign are in a closed position, the second notch is positioned approximately 90-degrees clockwise from the first notch, so that when the first horizontal section of the engagement bar is retained in the second notch, the two panels of the sign are in the open position.

2. The locking mechanism in. accordance with claim 1, further comprising: a. the locking mechanism is affixed to the second panel so that the first vertical portion of the engagement bar is joined to the second panel by being within the cylindrical housing of the locking mechanism, the first horizontal section goes between the second panel and the first panel, and the remaining portions of the engagement bar serve to connect the first panel to the second panel by being retained in a retention means on the first panel so that as the engagement bar moves from the first notch to the second notch, the first panel moves correspondingly and respectively from a closed position to an open position.

3. The locking mechanism in accordance with claim 2, further comprising:

a. the first horizontal section of the engagement bar moves from notch to notch and is retained therein so that the first horizontal section of the engagement bar is retained in the first notch and the first panel and second panels are touching each other in the closed position;

b. the first vertical section of the engagement bar is engaged by the spring to the underside of the button of the locking mechanism; and c. to open the panels, the button is depressed to thereby put pressure on the spring within the cylindrical housing, the spring transfers the downward force from depressing the button to the top of the vertical section of the engagement bar, the engagement bar, when experiencing the downward force from the spring causes the first horizontal section of the engagement bar to be pushed below a rim of the bottom collar of the cylindrical housing, and once the first horizontal section of the engagement bar is below the rim of the bottom collar, the first panel is free to be moved by hand or swung over to the second notch, and once the first horizontal section of the engagement bar has been moved away from the first notch, the pressure on the button is released and therefore when the first horizontal section of the engagement bar reaches the second notch, the first horizontal section of the engagement bar is pulled up into the second notch and is retained therein because the top of the first vertical section of the engagement bar is no longer experiencing a downward force, and being attached to the spring, which in turn is attached to the underside of the button, is no longer displaced and therefore is forced by the spring to return to its original vertical position, and the two panels are present invention is "locked" into an open position.

4. The locking mechanism in accordance with claim 3, further comprising:

a. the two panels are closed by the first horizontal section of the engagement bar from the second notch back to the first notch, whereby the engagement bar is again pulled up into the first notch and is releasably "locked" in that position.

5. A wet floor caution sign placed on a floor, comprising:

a. a first panel which has feet adjacent a lower end, the first panel having two panel faces on opposite sides of the first panel onto which written information is placed, a second panel which is taller than first panel and which has feet adjacent a lower end, the second panel having a hand grip opening by which the sign is grasped by a hand and carried from one location to another, the second panel having two panel faces on opposite sides of the second panel onto which written information is placed thereby providing four panel faces onto which written information is placed;

b. the first panel has a distal side edge and a proximal side edge, the second panel has a distal side edge and a proximal side edge, the proximal side edges of the first and second panels are adjacent to each other, the proximal side edges of the first and second panels containing rotatable opening and closing means adjacent their respective bottom edges;

c. a spring actuated locking means located adjacent a top end of the proximal side edges of the first and second panels, the spring actuated locking means causing the two panels to be positioned at ninety degrees to each other when the sign is in the opened condition so that four panel faces are visible when the sign is placed of a floor, the spring actuated locking mechanism enabling the two panels to rest adjacent one another when the sign is in the closed condition;

d. a locking mechanism that controls the positions of the first and second panels relative to each other, the locking mechanism having a cylindrical housing, at a top end of the cylindrical housing is located a button, and at an opposite end of the cylindrical housing is a bottom collar, the bottom collar containing a first notch and a second notch; and e. an engagement bar comprised of a single rod having four sections which are generally right angle sections such that there are two sections of the rod are horizontally aligned and two sections of the rod that are vertically aligned, a first vertical section resides within the cylindrical housing and engages the button by a spring mechanism of the spring activated locking means, the spring mechanism being attached to an underside of the button on one end and to the first vertical section of the engagement bar at its other end, the first vertical section is followed by a first horizontal section of the engagement bar, the first horizontal section of the engagement bar exits the cylindrical housing at the bottom collar and engages with the two notches in the bottom collar, one notch at a time, the first notch is positioned such that when the first horizontal portion of the engagement bar is retained in the first notch, the two panels of the sign are in a closed position, the second notch is positioned approximately 90-degrees clockwise from the first notch, so that when the first horizontal section of the engagement bar is retained in the second notch, the two panels of the sign are in the open position.

6. The wet floor caution sign in accordance with claim 5, further comprising:

a. the rotatable opening and closing means further comprises the proximal side edge of one panel contains a post adjacent its lower end and the proximal side edge of the other panel contains a collar which rotatably fits over the post, the combination post and collar providing the rotatable opening and closing means.

7. The locking mechanism in accordance with claim 6, further comprising:

a. the locking mechanism is affixed to the second panel so that the first vertical portion of the engagement bar is joined to the second panel by being within the cylindrical housing of the locking mechanism, the first horizontal section goes between the second panel and the first panel, and the remaining portions of the engagement bar serve to connect the first panel to the second, panel by being retained in a retention means on the first panel so that as the engagement bar moves from the first notch to the second notch, the first panel moves correspondingly and respectively from a closed position to an open position.

8. The locking mechanism in accordance with claim 7, further comprising:

a. the first horizontal section of the engagement bar moves from notch to notch and is retained therein so that the first horizontal section of the engagement bar is retained in the first notch and the first panel and second panels are touching each other in the closed position;

b. the first vertical section of the engagement bar is engaged by the spring to the underside of the button of the locking mechanism; and c. to open the panels, the button is depressed to thereby put pressure on the spring within the cylindrical housing, the spring transfers the downward force from depressing the button to the top of the vertical section of the engagement bar, the engagement bar, when experiencing the downward force from the spring causes the first horizontal section of the engagement bar to be pushed below a rim of the bottom collar of the cylindrical housing, and once the first horizontal section of the engagement bar is below the rim of the bottom collar, the first panel is free to be moved by hand or swung over to the second notch and once the first horizontal section of the engagement bar has been moved away from the first notch, the pressure on the button is released and therefore when the first horizontal section of the engagement bar reaches the second notch, the first horizontal section of the engagement bar is pulled up into the second notch and is retained therein because the top of the first vertical section of the engagement bar is no longer experiencing a downward force, and being attached to the spring, which in turn is attached to the underside of the button, is no longer displaced and therefore is forced by the spring to return to its original vertical position, and the two panels are present invention is "locked" into an open position.

9. The locking mechanism in accordance with claim 8, further comprising:

a. the two panels are closed by a process which is nearly identical to the process which causes the two panels to be in the opened condition, the difference being the moving of the first horizontal section of the engagement bar from the second notch back to the first notch, whereby the engagement bar is again pulled up into the first notch and is releasably "locked" in that position.

* * * * *